United States Patent [19]

Hardwick et al.

[11] 4,091,478

[45] May 30, 1978

[54] BATH TUB LIFT CHAIR APPARATUS

[76] Inventors: Charles W. Hardwick, 600 W. 27th St., Sanford, Fla. 32771; Ann Hardwick Smith; Kinnaman Browning Smith, both of 702 Sargeant St., Waycross, Ga. 31501

[21] Appl. No.: 771,906

[22] Filed: Feb. 25, 1977

[51] Int. Cl.[2] ..... A47K 13/00; A47K 3/12

[52] U.S. Cl. ..... 4/185 L; 4/185 S; 297/270; 297/258

[58] Field of Search ..... 4/185 L, 185 R, 185 S, 4/162; 297/344, 345, 346, 347, 270, 310, 325, 258, 259, 307; 74/575, 578, 111

[56] References Cited

U.S. PATENT DOCUMENTS

| | | | |
|---|---|---|---|
| 2,187,283 | 1/1940 | Scheutz | 4/185 L |
| 2,697,475 | 12/1954 | Dueth | 4/185 L |
| 2,813,277 | 11/1957 | Zillt | 4/185 L |
| 2,968,814 | 1/1961 | Ashby | 4/185 L |
| 3,256,036 | 6/1966 | Nolan | 4/185 L |
| 3,289,217 | 1/1966 | Glover | 4/185 L |
| 3,624,666 | 11/1971 | Higgins | 4/185 L |
| 3,879,770 | 4/1975 | Grant | 4/185 L |
| 4,034,426 | 7/1977 | Hardwick et al. | 4/185 L |

*Primary Examiner*—Henry K. Artis

*Attorney, Agent, or Firm*—Duckworth, Hobby, Allen & Pettis

[57] ABSTRACT

An apparatus for raising and lowering invalids into a bath tub having a frame that fits onto the bath tub with a chair rockably mounted to the frame. The frame has a vertically extending and rotatably mounted, externally threaded member; and a chair supporting frame portion has an internally threaded sleeve riding thereon and supporting the chair. The chair is rockably mounted to the chair support frame and interconnected with a ratchet so as to rotate the elongated, threaded member with the ratchet as the chair rocks back and forth.

11 Claims, 2 Drawing Figures

BATH TUB LIFT CHAIR APPARATUS

BACKGROUND OF THE INVENTION

The present invention relates to a chair for a bath tub that allows an invalid to raise or lower himself for getting into and out of a bath tub; and especially to such a chair in which the invalid can raise or lower himself by the simple expedient of rocking the chair.

To the infirm or elderly, bathing can be a serious problem since it is often very difficult or impossible for such people to lift themselves into or out of a tub. Even with help, the problem exists, since manually lifting an adult into and out of a tub is a difficult procedure and the risk of injury to either party is great.

Mechanical lifting devices has been developed to aid invalids and elderly persons in getting into and out of a bath tub. Some of the prior devices have been unduly complicated and cumbersome. This adds to their expense and likelihood of breakdown and may limit their use to institutions, whereas many infirm or elderly have need for such lifting devices in their homes, which devices need to be sufficiently inexpensive that they can be afforded by the invalid or his family, and can be easily placed in a bath tub for use by the invalid. Even though such a device should be sufficiently inexpensive, it must also be of sufficient rigid construction so that the users will not have a fear of the device falling or collapsing. Other bath tub lifting devices for invalids require operation by an assistant to the invalid, thereby losing the advantage of the invalid being able to get himself into and out of the bath tub. Finally, it has been suggested for bath tubs to have incorporated therein, invalid seats, which can be lowered or raised by the operation of a valve, which in turn, operates a hydraulic cylinder, or the like, for raising or lowering the chair. This, however, requires complex plumbing in order to connect the lifting chair to the water pressure line and to the drain lines. In addition, these hydraulic-type systems are usually expensive and require permanent installation either in a custom-made bath tub or a substantially modified tub. This, in turn, requires replacement of the bath tub once the invalid has no further use for the seat. Other raising and lowering seats are mounted like a crane, with an overhead lift, which tends to be cumbersome as well as giving an insecure feeling to the invalid.

The present invention tends to overcome many of the problems of the prior art invalid chairs by providing a chair which can be inexpensively manufactured, easily and quickly attached to a bath tub, and then removed if no longer needed. The present invention also provides for the invalid to be able to raise or lower himself in the seat and means to assist him in getting into and out of the tub.

Typical prior art systems for raising and lowering invalids can be seen in U.S. Pat. No. 3,545,013, to Discoe, for a hydraulic cylinder raising and lowering bath tub chairs installed into a bath tub, and in U.S. Pat. No. 3,256,036, for a lift device for bath tubs, using hydraulic cylinders along with suction feet for holding the device in place in a bath tub. In U.S. Pat. No. 3,879,770, to Grant, another fluid-operated bath tub lift is provided in which the lift is attached to the back of the bath tub for raising and lowering a seat, while U.S. Pat. No. 3,624,666, to Higgins, teaches a device for assisting handicapped persons to get into and out of a bath tub having a rack and pinion system which is operated by an individual moving a lever back and forth to jack the invalid chair up, or to lower the invalid chair. However, inasmuch as most invalids are in a weakened condition, they do not have sufficient arm and body strength for the continuous back and forth motion and effort required to jack the invalid chair both down into the tub and back up when the invalid has completed his bathing.

SUMMARY OF THE INVENTION

A bath tub lift chair for assisting an invalid into and out of a bath tub has a support frame, having an elongated threaded member, rotatably attached to the frame. A chair support frame has a threaded sleeve operatively connected to the elongated, threaded member for movement thereon, responsive to the rotation of the elongated threaded member. A rockable chair is rockably mounted to the chair support frame, and thereby to the elongated threaded member and support frame. A ratchet is connected to the elongated threaded member and to the rockable chair for rotating the elongated threaded member responsive to the rocking of the chair, so that the chair may be raised responsive to the rocking of the chair. The connection between the chair and the ratchet is such that the connection is maintained as the chair is raised or lowered, and the chair is attached so as to be able to swing over the side of the bath tub, if desired, to assist an invalid in entering or leaving the tub.

BRIEF DESCRIPTION OF THE DRAWINGS

Other objects, features and advantages of the present invention will be apparent from the written description and the drawings in which.

DESCRIPTION OF THE PREFERRED EMBODIMENT

Figure 1:
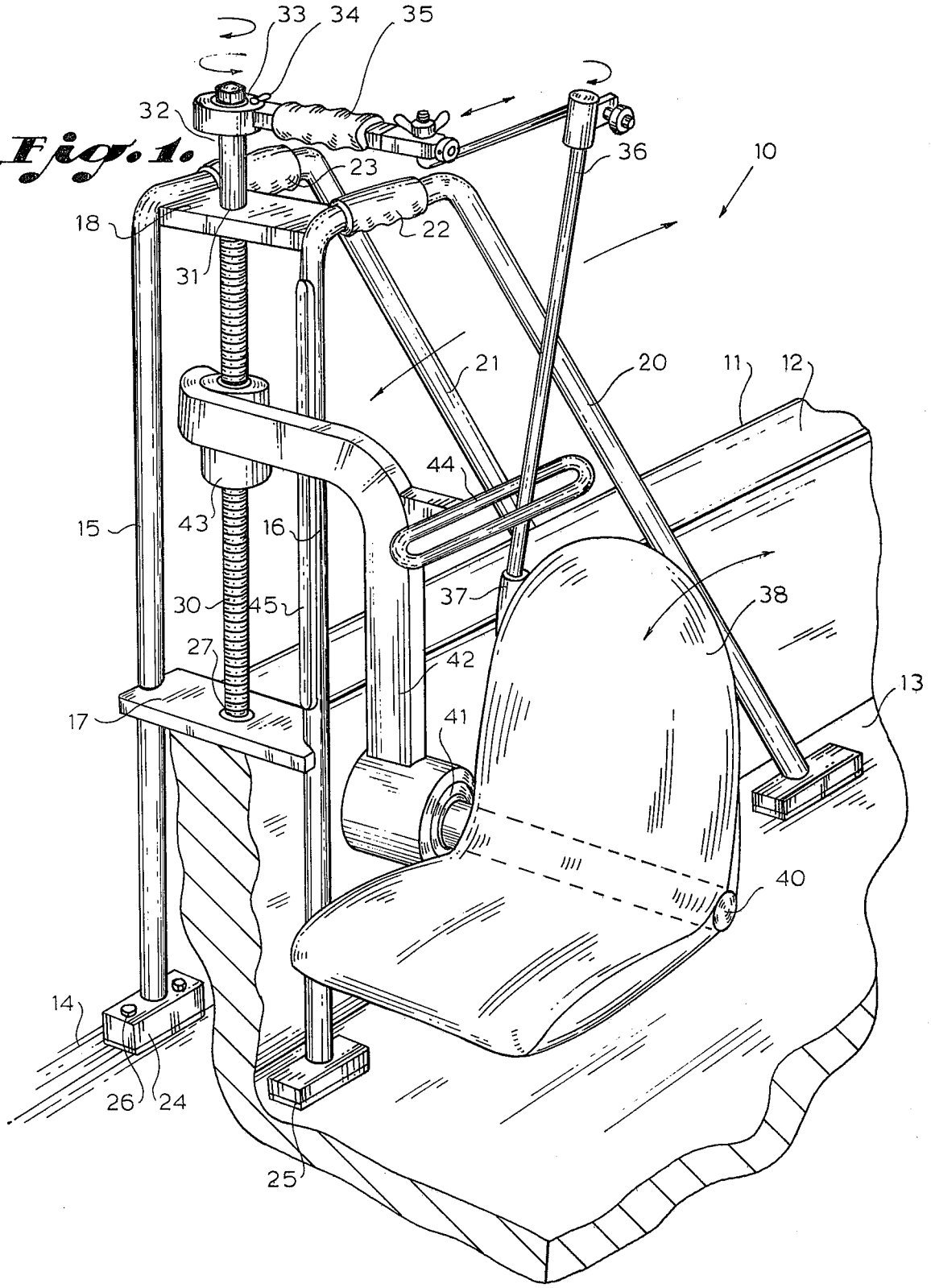
FIG. 1 is a perspective view of a bath tub lift chair for invalids attached to the bath tub.

Referring now to the drawings, a bath tub chair 10 is illustrated mounted to a bath tub 11 side wall 12, and braced against the bottom 13 of the tub and against the bathroom floor 14. The bath tub chair 10 has a framework having vertically extending frame members 15 and 16 connected by a pair of flat, support members 17 and 18. The frame also has a pair of angled frame members 20 and 21 connecting to the frame members 15 and 16 by horizontally extending portions having handles 22 and 23 thereon. It will, of course, be clear from the illustration that frame members 15 and 21 are formed from one continuous piece of metal and frame members 16 and 20 are formed from one continuous member. Each of the frame members has base feet 24 which may have rubber feet 25 and a pair of bolts 26 anchoring the frame members 15 and 21 outside of the bath tub to the bathroom floor 14. Frame member 17 may ride on the side 12 of the bath tub and may have a bushing or bearing 27 mounted therein for an elongated threaded shaft to ride in, while the frame member 18 may have a bearing or bushing 31 therein for the threaded shaft 30 to rotate in. The threaded shaft 30 has an extended portion 32 extending above the portion 31 and has a ratchet mechanism 33 attached thereto, which ratchet mechanism may be similar or the same as a standard ratchet wrench, and which may have a forward and reverse positioning switch 34 thereon, and may also include a release of the latching mechanism. Typically, a ratchet operates on a ratchet and pawl mechanism mounted with a handle 35, or the like, extending therefrom. In the present case, the handle, or lever 35 has an elongated shaft 36 protruding downward therefrom and passing loosely into a sleeve 37 which is attached to the invalid chair 38. The invalid chair 38 may be of molded plastic or of any material desired with reinforcing to support a steel shaft 40 connected thereto. The shaft 40 rides in a heavy bearing 41 connected to the invalid chair support framework 42 which extends up to and has a threaded sleeve 43 mounted on the opposite end thereof which is threaded through the elongated shaft 30 and rides thereon. The chair 38 can, of course, rotate on the shaft 40 or be fixedly attached to the shaft 40 and rotate in the bearing 41 as illustrated and may have stop 44 to limit the distance the chair 38 can rock back and forth. The stop can, of course, be mounted to the chair support framework 42 adjacent the bearing 41 with interconnecting tabs on the chair 38 or by any other means desired without departing from the spirit and scope of the invention.

Figure 2:
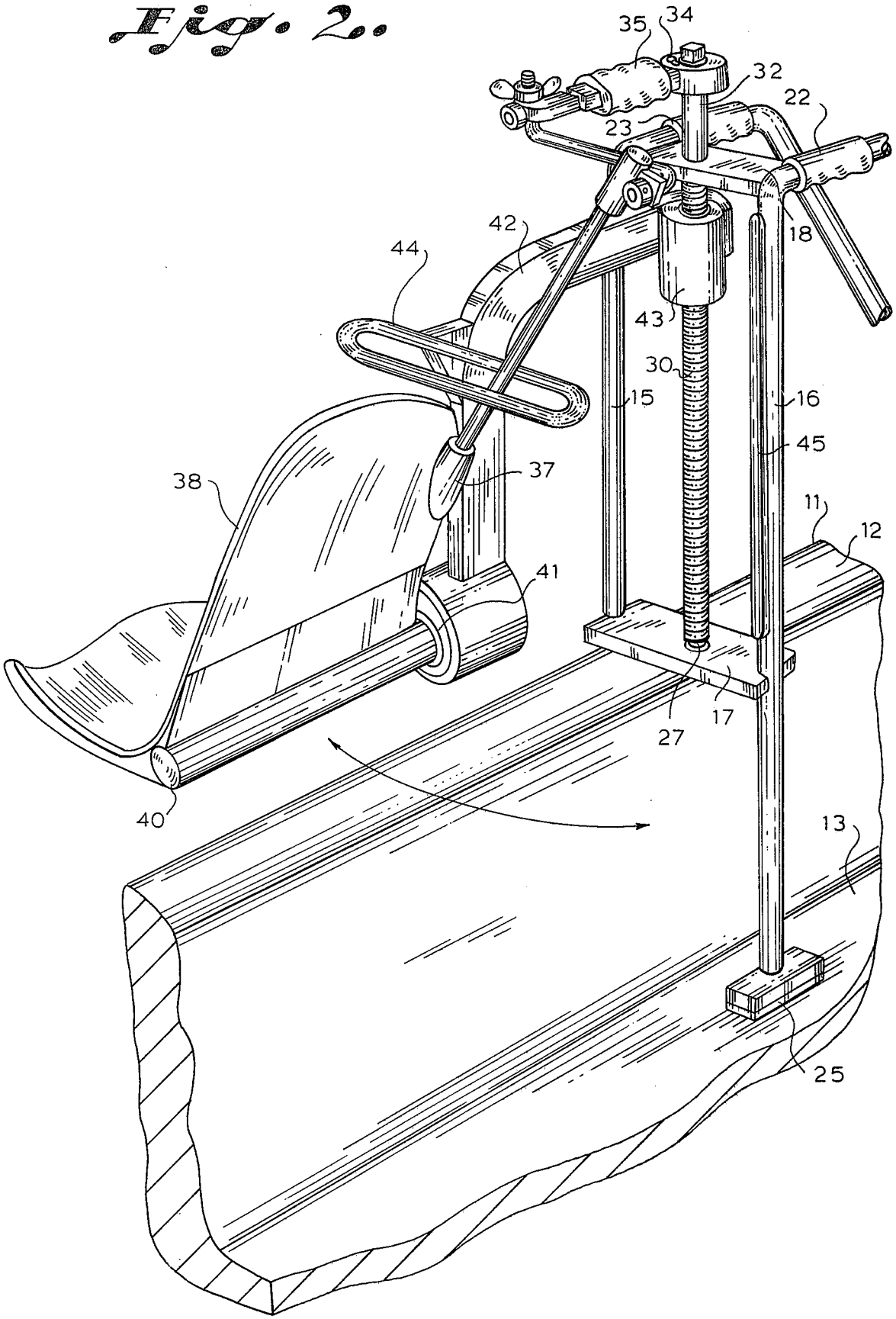
FIG. 2 is a perspective view of a bath tub lift chair with the chair swung over the side of the bath tub.

Thus, in operation, the invalid can sit in the chair with the switch 34 positioned to lift and rock the chair 38 back and forth in a conventional manner, thereby moving the shaft 36 and the handle 35 to ratchet the ratchet mechanism 33 to rotate the elongated threaded shaft 30. The rotation of the shaft 30 in the bearings 27 and 30 will raise the chair framework 42 by the sleeve 43 riding in the threads of the threaded shaft 30. As the chair raises, the shaft 36 slides further into or through the sleeve 37. When the chair is raised to the proper position, the invalid can raise his legs and swing the chair over around the side of the bath tub 12 as illustrated in FIG. 2. To lower himself, the invalid can sit in the chair as illustrated in FIG. 2, swing it around in to the tub, adjust the control 34 to either reverse or disconnect the ratchet and pawl mechanism. The chair 38 will ride slowly down the gear shaft 30 responsive to the weight of the invalid in the chair. In the reverse position, the invalid would have to rock the chair down into the tub. A stop and guide member 45 may be used to swing the chair frame 42 against, for positioning and guiding up and down in the tub. It will be clear to those skilled in the art at this point that an invalid chair which can be easily rocked up and down has been provided. It should be clear, however, that a wide variety of variations in the framework and the support can be utilized without departing from the spirit and scope of the invention. For instance, additional frame members can be utilized on the opposite side of the bath tub as well as additional support riding on the opposite side of the bath tub and mounted to the chair 38. It will also be clear that while the principal components are anticipated being made of steel, they could be made of any material desired which is sufficiently strong to support the chair and the invalid. Accordingly, the present invention is not to be construed as limited to the particular forms shown, which are to be considered illustrative rather than restrictive.

We claim:

1. A bathtub lift chair comprising in combination:

a frame;

an elongated threaded member rotatably attached to said frame;

a chair support frame having a threaded portion operatively connected to said elongated threaded member for movement thereon responsive to the rotation of said elongated threaded member;

a chair rocking support shaft attached to said chair support frame for movement therewith;

a rockable chair rockable mounted on said chair support shaft; and ratchet means connected between said elongated threaded member and said rockable chair for rotating said elongated threaded member responsive to the rocking of said chair, whereby said chair may be raised responsive to the rocking thereof.

2. The apparatus in accordance with claim 1, in which a sleeve is mounted to the back of said rockable chair and said ratchet means has a rod extending therefrom and passing through said sleeve attached to said chair whereby rocking said chair will move said rod back and forth, thereby moving said ratchet means to rotate said elongated threaded member.

3. The bath tub lift chair in accordance with claim 2, in which said rod is attached to a ratchet handle.

4. A bath tub lift chair in accordance with claim 3, in which said ratchet handle has a ratchet mechanism attached to said elongated threaded member for rotating said elongated threaded member by the ratcheting of said handle.

5. A bath tub lift chair, in accordance with claim 4, in which said ratchet mechanism has a reverse switch thereon for reversing the direction of the ratcheting, whereby a user can rock said rockable chair to raise or lower said chair.

6. The bath tub lift chair in accordance with claim 5, in which said ratchet mechanism and control includes a release for disconnecting the ratchet mechanism from said elongated threaded member.

7. A bath tub lift chair in accordance with claim 1, in which said frame has a plurality of vertically extending members mounted over either side of one side of a bath tub and is supported thereby.

8. The apparatus in accordance with claim 1, in which said rockable chair is rockably mounted to said chair support frame and said chair support frame is swingably mounted to said frame for swinging said chair over the side of a bath tub when in a raised position.

9. The apparatus in accordance with claim 1, in which said frame includes an elongated threaded member support members rotatably mounting said elongated threaded member thereto.

10. The apparatus in accordance with claim 9, in which said frame has support feet attached thereto.

11. The apparatus in accordance with claim 1, in which said chair support frame and said rockable chair have means to limit the distance said chair can be rocked.

* * * * *